US012044109B2

(12) United States Patent
Germino Ferreira Da Silva

(10) Patent No.: US 12,044,109 B2
(45) Date of Patent: Jul. 23, 2024

(54) GAS-LIFT MANDREL PROVIDED WITH A SCALE INHIBITOR INJECTION SYSTEM

(71) Applicant: Petróleo Brasileiro S.A.—Petrobras, Rio de Janeiro (BR)

(72) Inventor: Mario Germino Ferreira Da Silva, Rio de Janeiro (BR)

(73) Assignee: Petróleo Brasileiro S.A.—Petrobras (BR)

( * ) Notice: Subject to any disclaimer, the term of this patent is extended or adjusted under 35 U.S.C. 154(b) by 0 days.

(21) Appl. No.: 17/988,902

(22) Filed: Nov. 17, 2022

(65) Prior Publication Data

US 2023/0151718 A1 May 18, 2023

(30) Foreign Application Priority Data

Nov. 18, 2021 (BR) ..... 10 2021 023231 5

(51) Int. Cl.
*E21B 43/12* (2006.01)
*E21B 41/02* (2006.01)

(52) U.S. Cl.
CPC ..... *E21B 43/122* (2013.01); *E21B 41/02* (2013.01)

(58) Field of Classification Search
CPC ..... E21B 43/122; E21B 41/02
USPC ..... 166/372
See application file for complete search history.

(56) References Cited

U.S. PATENT DOCUMENTS 4,067,350 A * 1/1978 Raggio ..... E21B 43/123 137/155
6,070,608 A * 6/2000 Pringle ..... E21B 43/1235 137/155
7,213,607 B2 * 5/2007 De Almeida ..... E21B 23/03 137/155
2003/0056952 A1 * 3/2003 Stegemeier ..... E21B 47/113 166/250.12
2008/0179063 A1 * 7/2008 Smith ..... E21B 43/122 166/252.1

FOREIGN PATENT DOCUMENTS

BR 102012010426 B1 2/2021

* cited by examiner

*Primary Examiner* — William D Hutton, Jr.
*Assistant Examiner* — Ashish K Varma
(74) *Attorney, Agent, or Firm* — Mintz, Levin, Cohn, Ferris, Glovsky and Popeo, P.C.

(57) ABSTRACT

The invention discloses a chemical injection system adapted inside of the gas lift mandrel, such scale inhibitor injection system being intended to protect the chemical injection valve as well as the check valves and will also prevent scale deposition on the column above the gas lift mandrel due to dehydration caused by dry gas.

4 Claims, 7 Drawing Sheets

GAS-LIFT MANDREL PROVIDED WITH A SCALE INHIBITOR INJECTION SYSTEM

CROSS-REFERENCE TO RELATED APPLICATION

This application claims priority to Brazilian Application No. 10 2021 023231 5, filed on Nov. 18, 2021, and entitled "GAS-LIFT MANDREL PROVIDED WITH A SCALE INHIBITOR INJECTION SYSTEM," the disclosure of which is incorporated herein by reference in its entirety.

FIELD OF THE INVENTION

The present invention is related to the field of preventing and controlling scaling in production columns, more specifically related to a gas lift mandrel and the injection of inhibitors.

DESCRIPTION OF THE STATE OF THE ART

The technical problem that motivated the invention are check valve failures in gas lift mandrels, one of the causes of which is the scaling in check valves that causes their malfunction. This phenomenon can take place even before using the gas lift mandrel, due to issues of balance of pressures downstream and upstream of the check valves, which allows the wellbore annulus fluid to pass through the check valves into the production column and the fluid from the column to pass into the annulus of the well. The solution achieved by the invention is the injection of a scale inhibitor to prevent the formation of salt scales in check valves, in order to prevent the check valve of the gas lift mandrel from failing and therefore avoiding failure of the gas lift mandrel.

At the end of the completion of a well, the production column is installed prior to installation of the production packer to attach the column to the well, the annulus fluid is exchanged for an anticorrosive fluid, this fluid is placed between the column and the production well casing. The fluid is practically close to the tubing hanger, at the top of the casing below the Christmas tree and in this way there is a fluid height in the annulus of the wellbore above the gas lift mandrel, and it remains so until gas injection is necessary to reduce the hydrostatic column weight and hence the pressure needed to lift the produced oil.

The fact is that during this period while gas has not been injected yet, due to issues of changes in the behavior of the external pressures exerted by the fluid on the annulus and the internal pressures exerted by the flow pressure on the production column, there is a risk that these variations may cause displacement of the check valves that placed inside the mandrel at the interface between the column and the annulus. This displacement effect allows the passage of fluid from the annulus to the interior of the column, when such fluid meets the saline fluid of the wellbore BSW scaling is formed and hence the deposition on the check valve, leading to their loss of function and the possibility of passing the produced fluid to the annulus of the well.

A second type of issue begins exactly when the gas injection starts through the gas lift mandrel; since the gas is dry, when this gas finds the water in the production BSW a phenomenon of dehydration of the oil through the passage of the water from the oil to the gas phase takes place. Due to such evaporation of water, the salt concentration increases until it exceeds the saturation limit of salts in the BSW water, then at this moment the salts come out of the solution and precipitate in the production column above the gas lift mandrel. Such scaling forms an internal ring of salts and the column gradually increases in thickness, leading to the formation of a head loss zone, hence reducing the wellbore production flow, that is, leading to production losses.

As an example, the gas lift valve has been removed from one wellbore due to malfunction.

Strontium sulfate scaling was seen in the valve due to the phenomenon of mixing the water produced by the wellbore, which contains barium and strontium cations, with the annular fluid prepared with sea water, which has sulfate anions and the mixture of both fluids produced the scale that deposited on the valve.

Document BR102012010426B1 discloses an injection mandrel for the injection of a scale inhibitor fluid around the internal diameter of a production column in hydrocarbon production systems.

Document U.S. Pat. No. 7,213,607B2 discloses a mandrel for a gas lift valve comprising an elongated body whose ends are provided with connection means. The body is provided with a side pocket and a side receptacle, the interior of said receptacle housing a gas lift valve that injects gas into the mandrel body through holes.

Document US20080179063A1 discloses a system that injects lift gas and chemicals into an oil production well.

None of the cited prior-arts has the ability of inserting a chemical injection mandrel into a gas lift mandrel so that gas and inhibitor are injected simultaneously. In addition, documents BR 10 2012 010426-1 and US20080179063A1 describe systems that are not present in a floating type platform, such as, for example, in FPSO (Floating, Production, Storage and Offloading), where Christmas trees are placed at the sea bottom, which systems require a stricter safety control for issues of disruption of the production lines, such as in instances of hurricanes, to prevent the wellbores from producing to the sea bottom through the hydraulic lines in case of rupture due to accidents such as hurricanes.

In view of the difficulties present in the cited state of the art and to provide solutions for scale inhibition and gas injection, there is a need to develop a technology with good performance being in accordance with environmental and safety guidelines. The aforementioned state of the art does not have the unique features that will be presented in detail below.

OBJECT OF THE INVENTION it is an object of the invention to solve or minimize the issues of the state of the art by adapting a chemical injection system placed inside the lift gas mandrel.

BRIEF DESCRIPTION OF THE INVENTION

The invention discloses a chemical injection system adapted inside of the gas lift mandrel, such scale inhibitor injection system being intended to protect the chemical injection valve as well as the check valves and will also prevent scale deposition on the column above the gas lift mandrel due to dehydration caused by dry gas.

BRIEF DESCRIPTION OF THE DRAWINGS

The present invention will be described in more detail below with reference to the attached figures which represent examples of its embodiments schematically and non-exhaustively. In the drawings.

DETAILED DESCRIPTION OF THE INVENTION

Figure 1:
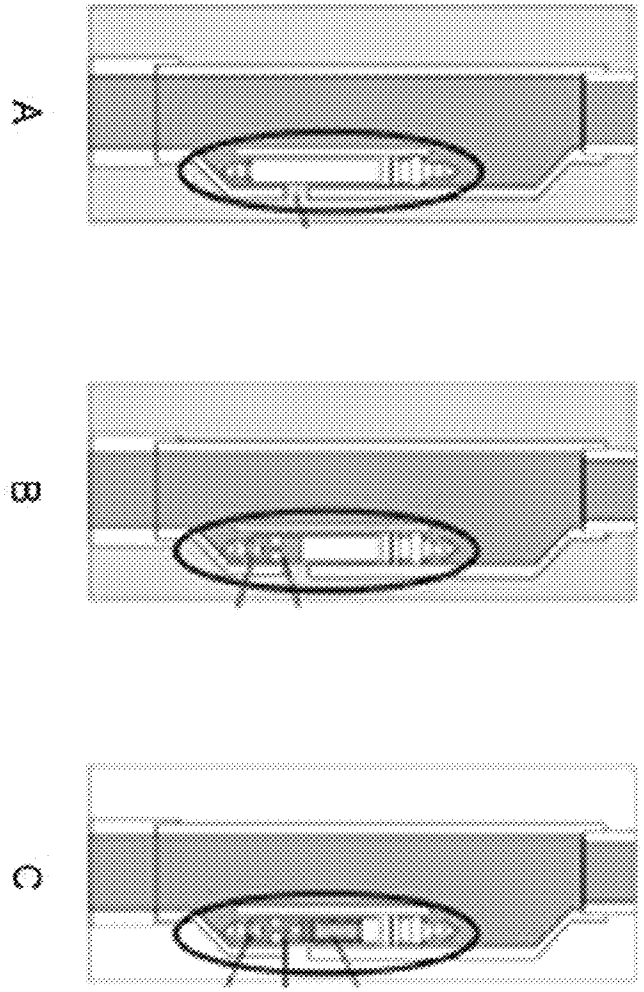
FIG. 1 illustrates the types of gas lift valves, blind type (A), orifice type (B) and calibrated type (C)

Below is a detailed, non-exhaustive and exemplary description of a preferred embodiment of the present invention. Nevertheless, possible additional embodiments of the present invention still comprised by the essential and optional features below will be evident to a person skilled in the art from reading this description.

The invention solves or minimizes the problems described above by adapting a chemical injection system inside of the gas lift mandrel, such scale inhibitor injection system being intended to protect the chemical injection valve as well as the check valves and will also prevent scale deposition on the column above the gas lift mandrel a dehydration caused by dry gas.

The technical advantages are a better efficiency of the gas lift mandrel and therefore a better management of the production and reservoirs through a guarantee of efficient flow. The economic advantages are avoiding production losses associated with stoppages to carry out scale removal operations and/or replacement of gas lift mandrel valves when they fail, and also the reduced costs associated with the elimination of operations that use critical resources such as intervention probes and/or stimulation boats to meet the described operations in wellbores.

The technology of the gas lift mandrel with inhibitor injection can be fully applied in the development of Petrobras' E&P production, in production systems both in the pre-salt and in the post-salt, in elevation and flow sites aiming at guaranteeing the flow (Garantia de Escoamento, GARESC), in wellbore sites in wellbore completion projects, requiring only adjustments in the manufacturing project of the gas lift mandrels to include adaptation of the chemical injection system in the lower part of the gas lift mandrel, exactly at the interface of the check valves with the annulus of the well, so that the chemical inhibitor can reach the planned position to guarantee the effectiveness of the treatment, aiming to protect, respectively, the check valves, the mandrel injection valve and the production column at the portion above the mandrel.

The mandrel of the present invention guarantees the yield of oil fields and their economy. It reduces the need to remove saline scaling. It reduces the use of critical resources such as completion probes and or stimulation boats. It reduces production losses associated with scaling formation in production columns. It improves the technique aiming at inhibiting organic depositions. Significantly lower costs than conventional squeeze and or removal because since once installed in the column it allows management of the scaling. It reduces the use of critical resources such as probes and/or stimulation boats as proportionally this reduction in the number of operations with critical resources promotes an increase in safety conditions so as not to cause impacts on the health of professionals and society. It also reduces the waste discharged by these vessels (probes and/or stimulation boats) into sea during the period where they are operating in the sea through the UEP's in the subsea production systems, thus reducing the environmental impacts.

The chemical injection system consists of a rupture disk and a double check valve, The system to prevent breakage of the column will be adapted at the bottom of the gas-lift mandrel in order to ensure that the injected inhibitor flow promotes protection of the check valves (20) of the gas-lift mandrel as well as the gas-lift mandrel valve. The system to prevent column breakage (22) can be installed above or below the chemical injection valve (09) inside the chemical injection mandrel (08) inserted into the gas-lift mandrel. The system to avoid column breakage (22) is used to avoid discharging the bulk of scaling-inhibiting fluid due to the large hydrostatics that depends on the length of the hydraulic line, which can cause effects such as loss of product dosage and clogging of the hydraulic line due to evaporation of the inhibitor solvent.

Figure 2:
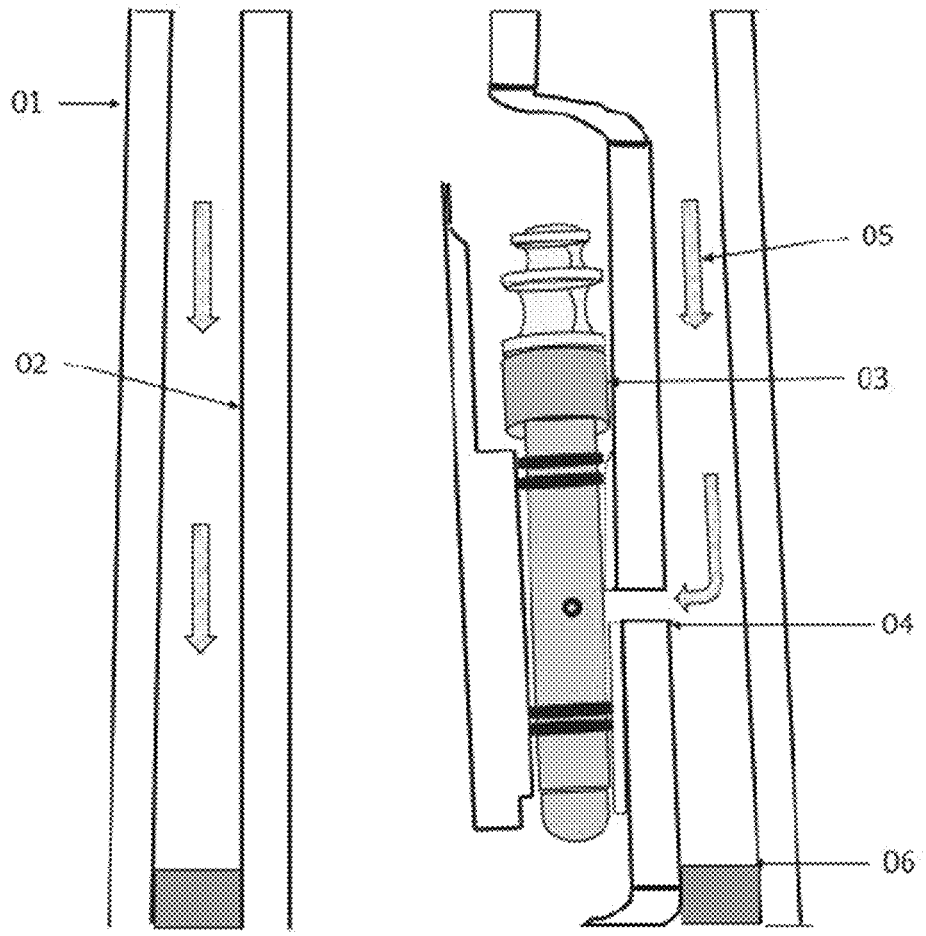
FIG. 2 illustrates a schematic cross-section of the gas lift mandrel.

FIG. 1 illustrates the types of gas lift valves, blind type (A), orifice type (B) and calibrated type (C);

FIG. 2 shows a schematic cross section of the lift gas mandrel showing the gas lift valve and the gas inlet hole coming from the annulus to the inside of the mandrel. It shows the casing (01), the gas lift mandrel body (02), the gas mandrel valve (03), the gas inlet hole (04) coming from the annulus of the gas mandrel, gas flowing down (05) through the annulus of the gas mandrel and the completion fluid level in the annulus (06).

Figure 3:
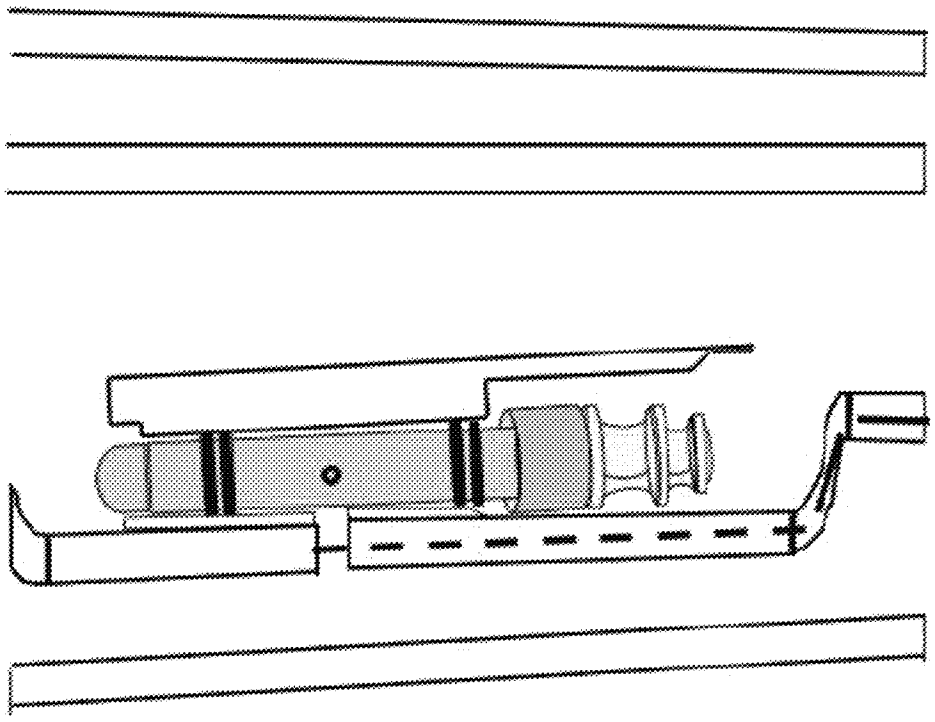
FIG. 3 illustrates another schematic cross-section of the gas lift mandrel.

FIG. 3 shows a schematic cross-section of the gas lift mandrel (07) showing the lift gas valve and the hydraulic line machined into the mandrel body to the gas inlet hole coming from the annulus to the inside of the mandrel (dashed line).

Figure 4:
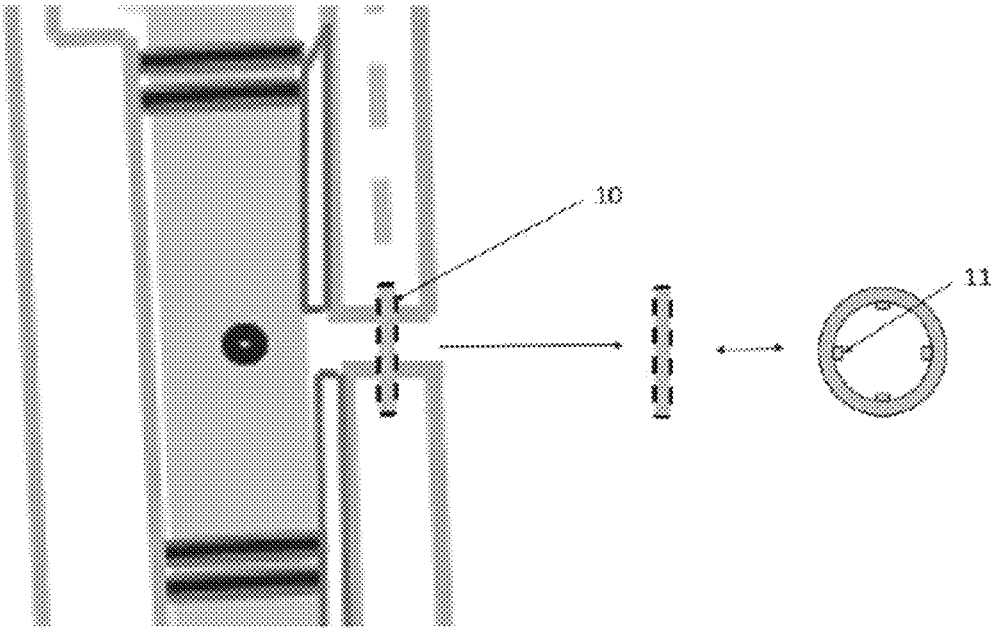
FIG. 4 illustrates in detail the chemical injection ring inserted in the gas lift mandrel structure.

FIG. 4 illustrates in detail the chemical injection ring (10) inserted into the gas lift mandrel structure placed internally to the hole through which the gas enters the gas lift mandrel. Showing side and front views of the ring (10) with four injector nozzles (11).

Figure 5:
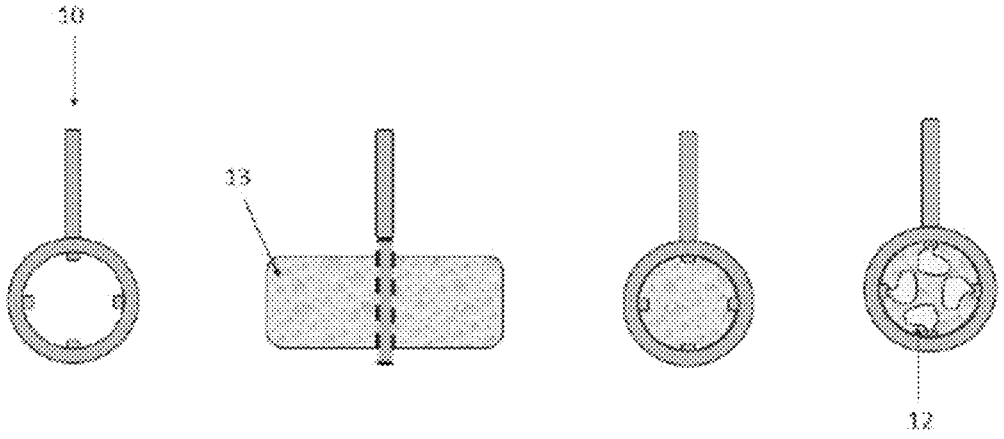
FIG. 5 illustrates the scheme of the chemical injection ring injecting scale inhibitor.

FIG. 5 illustrates the scheme of the chemical injection ring (10) injecting scale inhibitor (12) into the gas (13) when the gas passes from the annulus of the wellbore to the gas lift mandrel.

Figure 6:
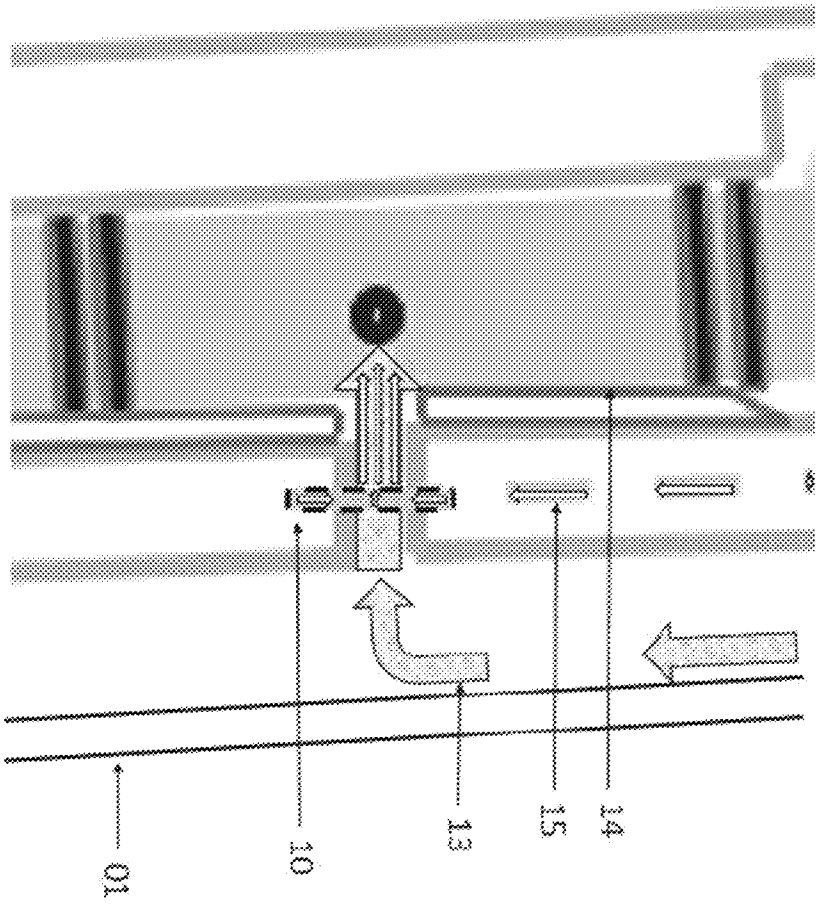
FIG. 6 illustrates a schematic detail of the chemical injection ring inserted into the gas lift mandrel structure.

FIG. 6 illustrates in detail a scheme of the chemical injection ring (10) inserted into the gas lift mandrel structure (07) placed internally to the hole through which the gas (13) enters the valve (14) of the gas lift mandrel (07). Injection of inhibitor fluid (15) is further illustrated in the figure.

Figure 7:
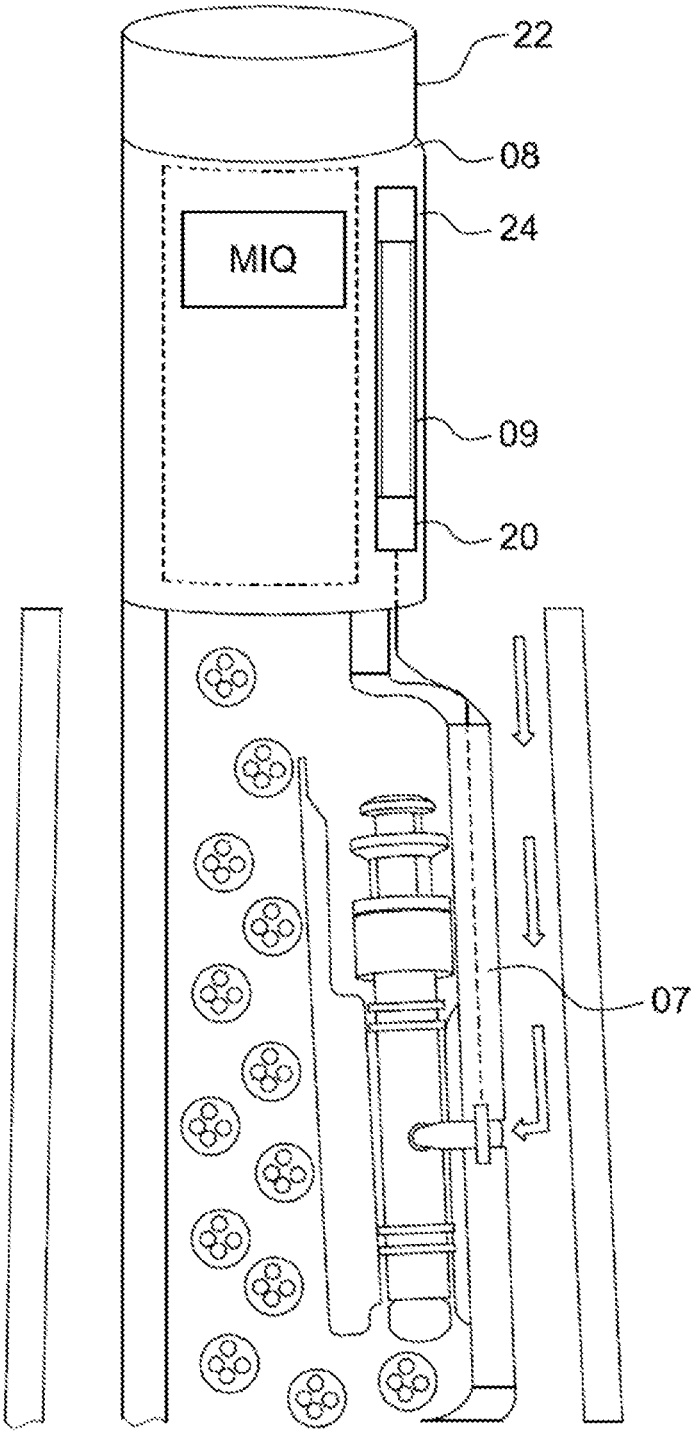
FIG. 7 illustrates a schematic cross-section of the gas lift mandrel showing the chemical injection mandrel (MIQ) inserted above the gas lift mandrel.

FIG. 7 illustrates a schematic cross-section of the gas-lift mandrel showing the chemical injection mandrel (MIQ) inserted above the gas-lift mandrel. The idea is to include a chemical injection system in the design of the gas-lift mandrel at the top of the MGL to inhibit scaling. Thus, the gas-lift mandrel will come from the factory with the chemical injection system included, which will allow chemical injection to be used to protect the check valves (20) and the MGL valve from the formation of scale deposits. FIG. 7 shows the chemical injection mandrel (09) inserted into the gas-lift mandrel (08), the chemical injection valve of the injection mandrel (09) and the gas-lift mandrel (07) with the hydraulic line inserted into the structure of the gas-lift mandrel. The chemical injection valve of the chemical injection mandrel (09) includes the rupture disc (24) and the double check valve (20).

The invention claimed is:

1. A gas-lift mandrel to be installed within a production column provided with a scale inhibitor injection system:

a rupture disc and a double check valve present in a chemical injection valve;

a system to avoid breakage of the production column above or below the chemical injection valve inside a chemical injection mandrel;

a gas-lift mandrel body;

a valve of the gas mandrel;

a gas inlet hole;

a gas-lift mandrel;

a valve; and a chemical injection ring inserted into the gas-lift mandrel.

2. The mandrel, according to claim 1, wherein the chemical injection ring comprises four injector nozzles.

3. The mandrel of claim 1, wherein the chemical injection mandrel (MIQ) is inserted at a site above the gas-lift mandrel.

4. The mandrel of claim 1, wherein the scale inhibitor injection system is configured to inject scale inhibitors.

* * * * *